US007073286B2

(12) United States Patent
Paananen et al.

(10) Patent No.: US 7,073,286 B2
(45) Date of Patent: Jul. 11, 2006

(54) METHOD AND DEVICE FOR CLEANING THE BARREL OF THE GUN

(75) Inventors: Markku Paananen, Järvenpää (FI); Marja Koivuluoma, Järvenpää (FI)

(73) Assignee: Milfoam Oy (FI)

( * ) Notice: Subject to any disclaimer, the term of this patent is extended or adjusted under 35 U.S.C. 154(b) by 0 days.

(21) Appl. No.: 10/433,022

(22) PCT Filed: Nov. 29, 2001

(86) PCT No.: PCT/FI01/01043

§ 371 (c)(1),
(2), (4) Date: Oct. 7, 2003

(87) PCT Pub. No.: WO02/44642

PCT Pub. Date: Jun. 6, 2002

(65) Prior Publication Data

US 2004/0074523 A1 Apr. 22, 2004

(30) Foreign Application Priority Data

Nov. 29, 2000 (FI) ..... 20002621

(51) Int. Cl.
*F41A 29/00* (2006.01)

(52) U.S. Cl. ..... 42/95; 15/104.05; 15/104.095; 15/104.067

(58) Field of Classification Search ..... 42/95; 15/104.05, 104.095, 104.067
See application file for complete search history.

(56) References Cited

U.S. PATENT DOCUMENTS 514,514 A * 2/1894 Stafford ..... 15/104.05
883,986 A * 4/1908 Swazey ..... 15/104.05

(Continued)

FOREIGN PATENT DOCUMENTS

DE 278350 9/1914

(Continued)

OTHER PUBLICATIONS

English Translation of DE 40 24 541, Abstract.

(Continued)

*Primary Examiner*—M. Clement
(74) *Attorney, Agent, or Firm*—Andrus, Sceales, Starke & Sawall, LLP

(57) ABSTRACT

The present invention relates to a method for chemo-mechanical cleaning of the barrel of a gun, in which method the barrel is closed tightly from both ends and at least one cleaning chemical is introduced into the closed barrel, the chemical is allowed to react with the impurities on the interior surface of the barrel, the chemically treated residue is loosened mechanically, the residue is removed from the barrel and, if necessary, the barrel is rinsed and dried. According to the invention, at least one of the cleaning chemicals used is a gaseous cleaning chemical. The invention also relates to a device for cleaning the barrel of a gun, comprising end blocks (1,8) sealably fittable to each end of the barrel and a reciprocable mechanical cleaning element to be placed in the barrel. According to the invention, the cleaning element comprises a core sleeve (21) of a size smaller than the barrel caliber and a brush part (20) of a size adapted to the barrel caliber and freely rotatably mounted around the core sleeve, and a reciprocatingly-moved drive means (5, 12, 17) passed through the aperture of the core sleeve and designed to fit the length of the barrel, the core sleeve (21) and/or brush part (20) being attached to said drive means.

13 Claims, 5 Drawing Sheets

U.S. PATENT DOCUMENTS

| | | | | | |
|---|---|---|---|---|---|
| 1,004,710 | A | * | 10/1911 | Swazey | 15/104.05 |
| 2,606,567 | A | | 8/1952 | Cooper | |
| 4,290,163 | A | | 9/1981 | Opitz et al. | |
| 4,340,989 | A | * | 7/1982 | Rotondi et al. | 15/104.067 |
| 4,369,071 | A | | 1/1983 | Flach et al. | |
| 4,404,979 | A | | 9/1983 | Hobbs | |
| 4,482,469 | A | | 11/1984 | Plotze | |
| 4,726,137 | A | | 2/1988 | Zurek et al. | |
| 4,776,125 | A | * | 10/1988 | Black et al. | 42/95 |
| 5,743,040 | A | | 4/1998 | Kennedy | |
| 5,946,843 | A | | 9/1999 | Paananen | |

FOREIGN PATENT DOCUMENTS

| | | |
|---|---|---|
| DE | 705167 | 4/1941 |
| DE | 1289720 | 2/1969 |
| DE | 40 24 541 | 2/1992 |
| EP | 075 113 | 3/1983 |
| EP | 0 075 113 | 11/1984 |
| FI | 95507 | 10/1995 |
| FI | 97727 | 2/1997 |
| GB | 614592 | 12/1948 |

OTHER PUBLICATIONS

English Translation of Publication DE 278350, Claim 1.
English Translation of FI 97727, Claim 1.
English Translation of FI 95507, Claims 1 and 4.
English Translation of DE1289720, Claim 1.
English Translation of EP 0 075 113, Abstract, Specification.
English Translation of DE 705167, Claim 1.

* cited by examiner

METHOD AND DEVICE FOR CLEANING THE BARREL OF THE GUN

CROSS REFERENCE TO RELATED APPLICATION

The present application is the U.S. national stage application of International Application PCT/FI01/01043, filed Nov. 29, 2001, which international application was published on Jun. 6, 2002 as International Publication WO 02/44642. The International Application claims priority of Norwegian Patent Application 20002621, filed Nov. 29, 2000.

SUMMARY OF THE INVENTION

The present invention relates to a method as defined in the preamble of claim 1 and to a device as defined in the preamble of claim 10 for chemo-mechanical cleaning of the tube or barrel of a gun. Hereinafter, for the sake of simplicity, tube and barrel are referred to by the common designation 'barrel'.

The barrels of guns, e.g. portable firearms, tanks, cannons, various throwers or the like, have to cleaned at regular intervals of use to remove remnants of shells or bullets accumulated in the barrel as well as the crust accumulated from combustion residue, such as soot and gunpowder. In this context, remnants of shells refers to the metallic residue left in the barrel from the shell, e.g. copper, brass, bronze, zinc, aluminum, aluminum oxide or lead residue, depending on the structure of the shell. In addition, replacement barrels kept in store are checked at regular intervals, cleaning and inspecting the barrels and then greasing them again. This work is carried on as a full-time activity.

In prior art, many different methods for cleaning the barrels of guns are known. An example of prior-art methods is mechanical brushing, which is a laborious and slow operation and which can be somewhat accelerated by using a suitable known cleaning agent. However, the use of a cleaning agent does not completely eliminate the need for brushing.

When prior-art techniques are used, the cleaning of e.g. a cannon barrel, including brushing, removal of residues, eventual rinsing and greasing for storage, takes 4–7 hours on an average, i.e. in principle the treatment of a single barrel requires a whole working day.

Finnish patent 97727 presents a method for the cleaning of gun barrels that involves the use of a foamed cleaning agent. The cleaning agent composition contains tensides as well as alkanol-amide and/or nitrate salt as an agent for removing shell residue. Alkanol-amides have proved to be good agents for removing copper residue, and nitrate salts for removing zinc residue. In some cases this technique substantially reduces the need for mechanical cleaning, but especially in the case of large-caliber guns, mechanical cleaning is still necessary.

In addition, for the cleaning of a cannon barrel, there are also pneumatic and hydraulic systems.

The system known as "Coefa" is a hydraulic system that uses a brush that is pumped in a reciprocating manner by the force of a fluid. This is a closed system, but when used, it constitutes an environmental hazard due to the large quantities of oily and detrimental chemicals handled in it. This system also requires a large apparatus and is difficult to operate and handle even because of its size alone, so it is very poorly applicable in field conditions. Moreover, it requires a separate power source.

On the other hand, the system known under the designation "Break Free" works pneumatically. When in use, its brush is caused to move back and forth through the cannon barrel in a twitching fashion. The system is open, so it is not applicable for use with e.g. volatile or gaseous cleaning chemicals. The hoses of the apparatus follow the brush of the system as it is moving in the cannon barrel. This system, too, is mainly intended for use in repair shop conditions, as it requires a separate power source.

Previously known pneumatic and hydraulic cleaning systems are not applicable for implementing e.g. a method as disclosed in the present invention. They also involve heavy equipment and their use is therefore out of the question e.g. in field conditions.

DETAILED DESCRIPTION OF THE INVENTION

The object of the invention is to eliminate the above-mentioned drawbacks. A specific object of the invention is to disclose a new and improved method and device for cleaning the barrel of a gun. A further object of the invention is to disclose a device that is compact, fast and easy to use and that is applicable for the cleaning of the tubes and barrels of guns of all types in both repair shop and field conditions.

The method and device of the invention are characterized by what is presented in the claims.

The invention is based on a method for chemo-mechanical cleaning of a gun barrel in such manner that the barrel is closed tightly from both ends and at least one cleaning chemical is introduced into the closed barrel, the chemical is allowed to react with the impurities on the interior surface of the barrel, the chemically treated residue is loosened mechanically, the residue is removed from the barrel and, if necessary, the barrel is rinsed and dried. As a feature characteristic of the method, at least one of the cleaning chemicals used is a gaseous cleaning chemical.

In this context, the term 'gun' refers to any type and size of firearm used for shooting. The gun may be e.g. a portable firearm, a tank, a cannon, any type of thrower or the like.

In an embodiment of the invention, mechanical removal and eventual finishing treatment are carried out while the barrel is in a closed condition.

The invention provides the possibility of treating gun barrels in various ways using a gaseous cleaning chemical, which can be selected as appropriate for the barrel to be cleaned in each case. In one embodiment, the gaseous cleaning chemical can be e.g. introduced into a closed gun barrel, where it is allowed to act for a suitable length of time determined experimentally. After this, the remaining gas that has not been consumed in the reaction can be removed from the barrel and recovered. The barrel can be opened, and a further cleaning operation can be carried out on it using e.g. a liquid cleaning agent that acts on the impurities having reacted with the gaseous chemical and, as far as applicable, on impurities that have not reacted with it. The cleaning operation with a liquid agent can be assisted by conventional mechanical brushing methods, which are simultaneously used for mechanical removal of the impurities.

In an embodiment of the invention, at least one gaseous cleaning chemical is introduced into the barrel simultaneously with at least one other cleaning agent. In a preferred embodiment, at least one other cleaning agent used is a liquid cleaning agent, so the cleaning with the gaseous cleaning chemical and the cleaning with the liquid cleaning agent are thus advantageously performed at the same time.

In a particularly advantageous embodiment, the gaseous cleaning chemical is used for foaming the liquid cleaning agent. This can be accomplished e.g. by using a gaseous cleaning chemical as a propellant for introducing a liquid agent into the barrel. In this process, gas-generating reactions producing foaming are also possible. When the above-described procedure is followed, it is essential that the barrel should be kept closed at least during the chemical phase of the cleaning treatment. After the removal of the cleaning chemicals, the barrel may be opened to allow mechanical removal of cleaning residue if the gaseous cleaning chemical has been consumed substantially completely in the reaction and there is no risk of emissions of said chemical into the environment.

A treatment with a gaseous cleaning chemical can also be performed as an operation complementary to a chemical phase carried out using a liquid cleaning agent, in which case the gaseous cleaning chemical can be at least partially made to react with the impurities activated by the liquid cleaning agent.

Gaseous cleaning chemicals that have proved to be suited for use in the invention are oxygen, air, nitrogen and ammonia. Ammonia is preferably used in a strong concentration gasifiable from a liquid state. These cleaning chemicals can also be used to complement each other's effects, e.g. in staggered treatments.

The device of the invention for the cleaning of a gun barrel comprises end blocks sealably fittable to each end of the barrel and a reciprocable mechanical cleaning element to be placed in the barrel. According to the invention, the cleaning element comprises a core sleeve of a size smaller than the barrel caliber and a brush part of a size adapted to the barrel caliber and freely rotatably mounted around the core sleeve, and a reciprocatingly-moved drive means passed through the aperture of the core sleeve and designed to fit the length of the barrel, the core sleeve and/or brush part being attached to said drive means.

In an embodiment of the invention, the drive means is a cogged belt arranged to run round belt pulleys mounted on the two end blocks. By means of the belt pulleys, it is possible e.g. to adjust and tighten the cogged belt. In an embodiment, the shaft of one of the belt pulleys is a drive shaft connected via a gear system to an electric motor rotatable in both directions for receiving motion energy.

In an embodiment of the invention, at least one of the end blocks is provided with a control mechanism to allow the position of the belt pulley mounted on it to be adjusted in the direction of the barrel.

In an embodiment of the invention, the core sleeve and/or the brush part are/is attached to one track of the drive means, preferably to one track of a cogged belt.

In an embodiment of the invention, each end of the core sleeve is provided with a snap-in fastener, by means of which it can be fastened to a corresponding snap-in fastener of the drive means. In a preferred embodiment, each end of the cogged belt is provided with a snap-in fastener to which the snap-in fastener of the core sleeve can be fastened.

In an embodiment of the invention, the brush part is replaceable.

In an embodiment of the invention, the core sleeve is provided with an adapter plate extending eccentrically, these two parts together forming an eccentric structure. In an embodiment, the core sleeve is of an eccentric design, e.g. in that it has a larger wall thickness on one side.

In an embodiment of the invention, at least one of the end blocks comprises at least one port for the introduction of cleaning chemicals into the barrel, removal of cleaning residue from the barrel and rinsing and/or drying of the barrel. In an embodiment, the end block on the discharge end of the barrel comprises at least one inlet port for the introduction of cleaning chemicals into the barrel and at least one outlet port for the removal of cleaning residue from the barrel.

In this context, the term 'port' refers to any device through which it is possible to supply e.g. chemicals, air, gases, liquids or the like into the barrel. The port may preferably consist of e.g. a valve or an array of valves.

In an embodiment of the invention, the device comprises a portable control unit provided with logistics programs for different cleaning phases in the cleaning of barrels of different sizes. By means of the control unit and using the programs in it, the device independently carries out the various phases of the cleaning of the gun barrel, including final greasing if desired. Via the control unit, it is possible to adjust and alter the program for the cleaning of the gun barrel either before the cleaning action or during the cleaning action as required.

Thanks to the present invention, a method is achieved that allows a substantial improvement in the efficiency of chemical cleaning of a gun.

The problems associated with prior-art devices can be eliminated by using the device of the invention, which is additionally applicable for implementing the method of the invention. The device can be used with any desired or known cleaning chemicals.

The entire device is so compact that it can be packed in two suitcases, which can be carried by one man. In addition, the device has a simple construction and is therefore advantageous to implement.

The device is able to execute the entire cleaning process independently and automatically, controlled by its control unit. Under the control of its control unit, the device can also independently perform the final or storage greasing. Alternatively, the device can be operated manually if necessary, e.g. by connecting a crank to the shaft of a belt pulley. This is a great advantage as compared with prior-art solutions, which are completely unserviceable unless there is an external power source available.

By applying the invention, the entire process of cleaning the gun barrel can be executed considerably faster than with prior-art devices, in a preferable case in about 0.5–1 hour.

The invention has the advantage that no chemicals or other waste are emitted into the environment during the cleaning process.

The method and device of the invention are applicable for the cleaning of the barrels of different guns of different sizes, e.g. small-caliber firearms, cannons or throwers.

BRIEF DESCRIPTION OF THE DRAWINGS

In the following, the invention will be described by the aid of detailed examples of its embodiments with reference to the attached drawings, wherein.

DETAILED DESCRIPTION OF THE DRAWINGS

Figures 1A, 1B:
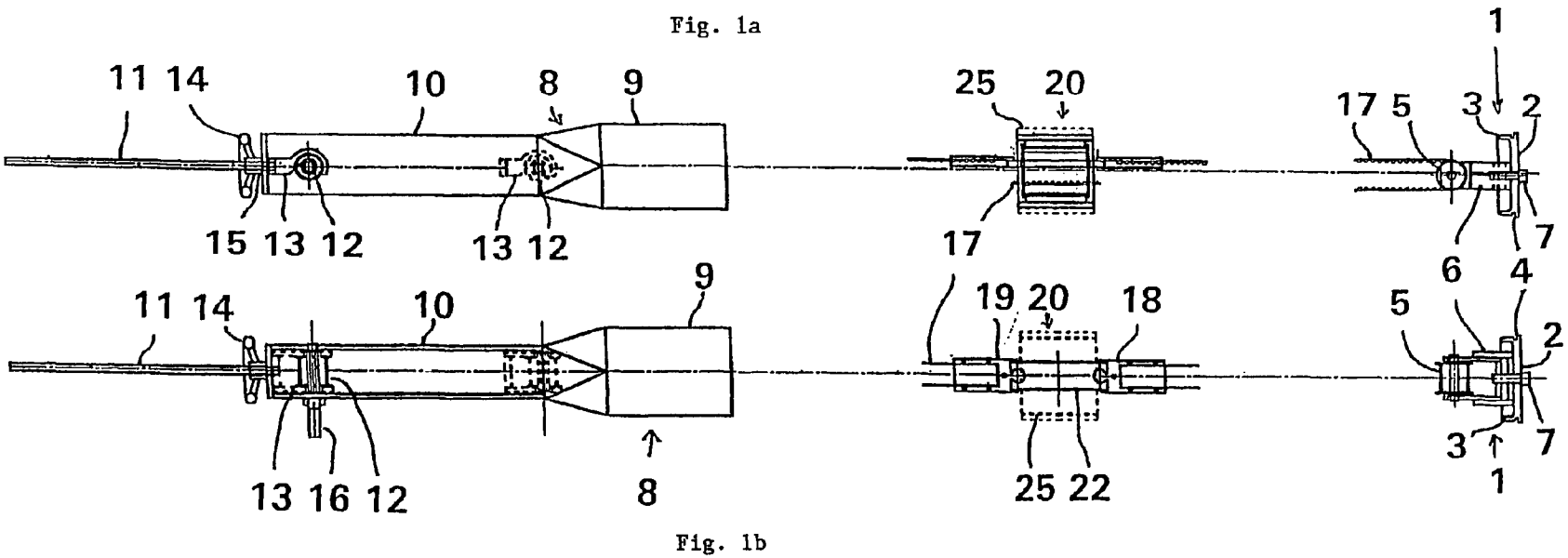
FIGS. 1*a* and 1*b* present an embodiment of the cleaning device of the invention in side view and in top view.
Figure 2A:
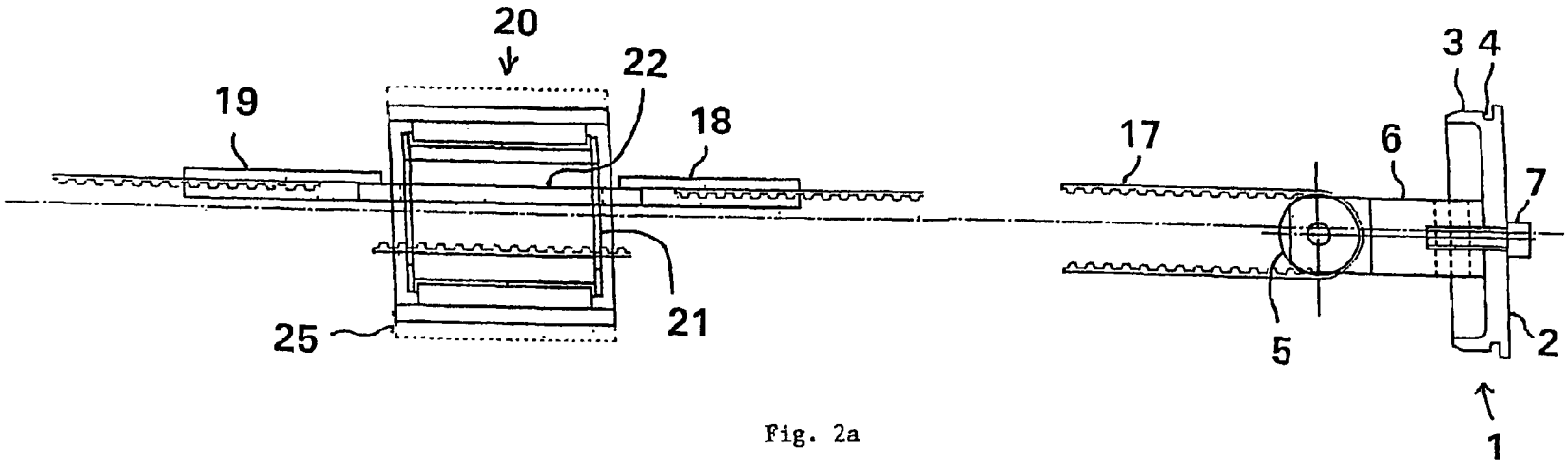
FIGS. 2*a* and 2*b* present magnified side and front views of that end block of a device according to the invention which is to be placed on the breech end of the barrel, and of a rotating brush attached to the cogged belt.
Figure 2B:
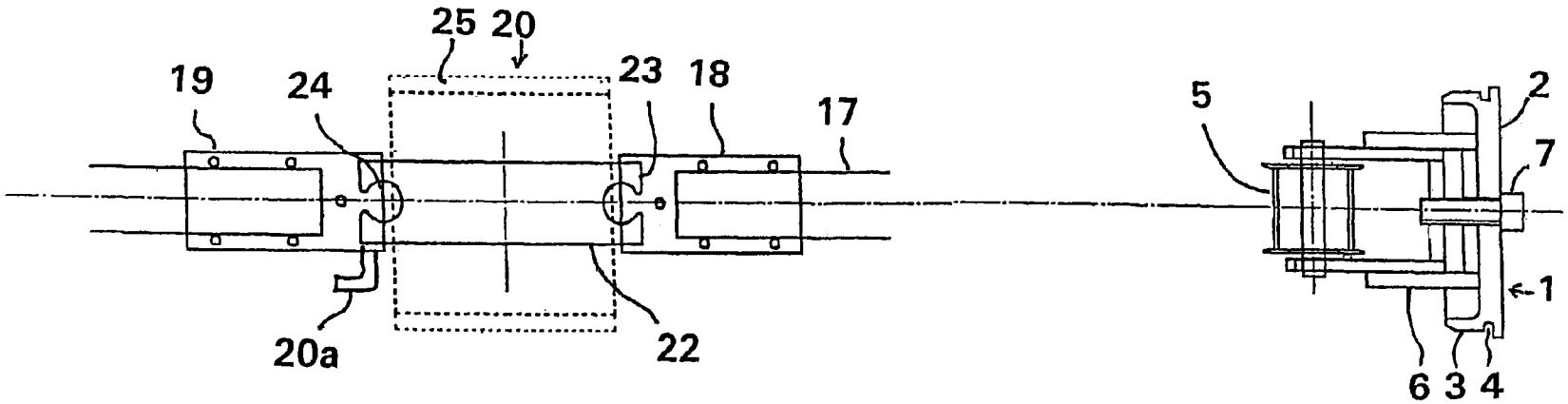
Figure 3A:
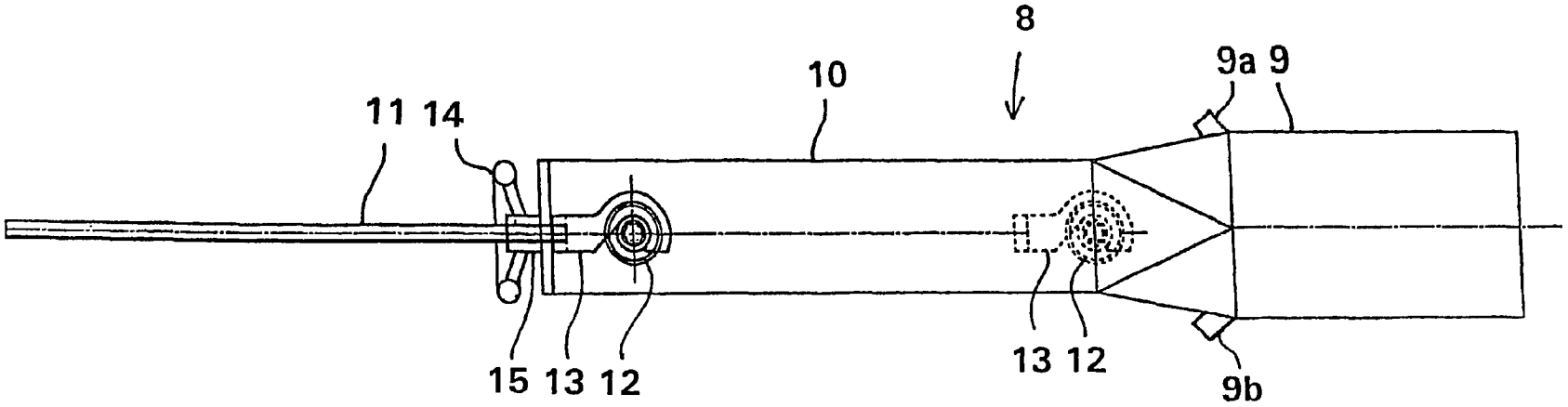
FIGS. 3*a* and 3*b* present magnified side and front views of that end block of a device according to the invention which is to be placed on the discharge end of the barrel.
Figure 3B:
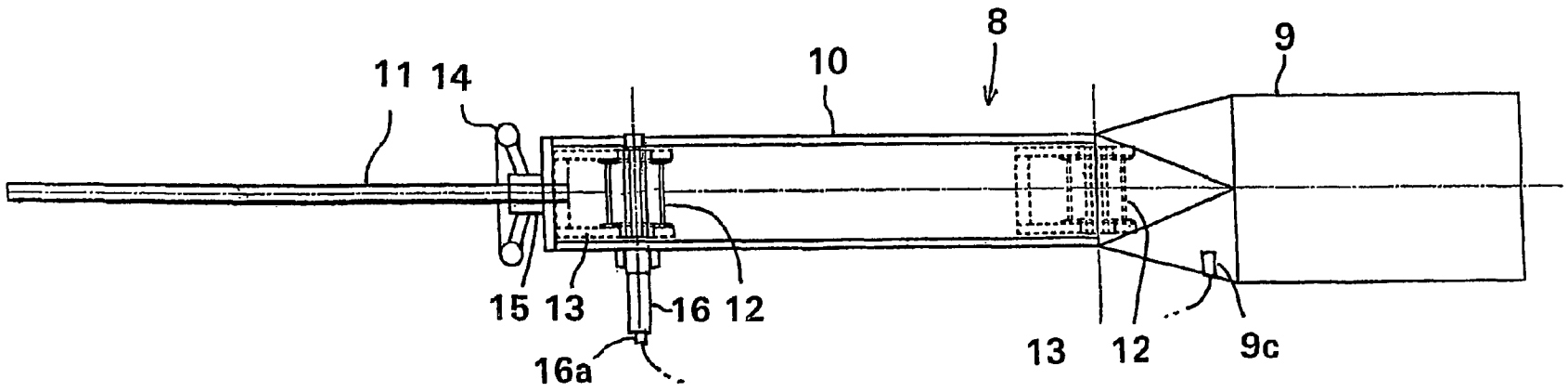

FIGS. 1*a–b*, 2*a–b* and 3*a–b* present an embodiment of the cleaning device of the invention for chemo-mechanical cleaning of a barrel. The device comprises a first end block 1, which can be sealably fitted to the breech end of the barrel and consists of an external end flange 2 and a collar 3 extending concentrically with said flange, which collar 3 can be inserted into the barrel and has a sealing ring 4 around its circumference. The collar 3 with the sealing ring 4 has to be dimensioned according to the caliber of the barrel so that the end block 1 can close the breech end of the barrel while also sealing it. Mounted inside the collar 3 is a mounting and adjustment yoke 6 for a first belt pulley 5, provided with a fine adjustment screw 7 extending in the direction of the center line of the end block 1 to allow the yoke to be adjustably moved in the direction of the longitudinal axis of the barrel.

The device presented in FIGS. 1*a–b*, 2*a–b* and 3*a–b* additionally comprises a second end block 8 designed to be sealably fitted to the discharge end of the barrel and tightened with a collar. This end block 8 comprises an end muff 9, which can be tightened at the discharge end of the barrel so as to seal it, and an operating part 10 extending coaxially with the end muff. The operating part 10 comprises a threaded rod 11 extending in the direction of the longitudinal axis of the barrel, and a tensioning yoke 13 attached to said rod and designed for the mounting of a second belt pulley 12. This yoke 13 can be moved axially along the operating part 10 by means of a nut 15 provided with a hand wheel 14 and acting on the threaded rod 11. The shaft 16 of the second belt pulley 12 is coupled via a gear system to an electric motor (not shown in the figure) capable of rotating in either direction. In FIGS. 1*a–b* and 3*a–b*, belt pulley 12 is shown both in its normal position, with the threaded rod 11 in an outer position, and in its extreme inner position, in which the belt pulley 12, enters partly inside the end muff 9. The belt pulley 12 is moved to this extreme position e.g. when the cleaning device is mounted in a barrel to be cleaned so that the means, i.e. cleaning element connecting the two end blocks 1 and 8 can be mounted in place.

The cleaning device presented in FIGS. 1*a–b*, 2*a–b* and 3*a–b* comprises a drive means consisting of a cogged belt 17, which is passed over the belt pulleys 5 and 12 of the two end blocks 1 and 8. In addition, the cleaning device comprises a non-rotating core sleeve 21 and a freely rotating brush part 20 mounted in connection with it. The brush part 20, dimensioned according to the barrel caliber, is mounted around the core sleeve 21 so as to be freely rotatable. Each end of the cogged belt 17 is provided with a snap-in fastener 18, 19, by means of which the core sleeve 21 and the brush part 20 can be attached to the cogged belt 17. Connected to the non-rotatable core sleeve 21 is an eccentrically extending adapter plate 22 having a snap-in fastener 23, 24 at either end, to which the snap-in fasteners 18 and 19 at the ends of the cogged belt 17 can be fastened. The snap-in fasteners may consist of any kind of fastening elements known in themselves, which will not be described here in detail.

Figure 5:
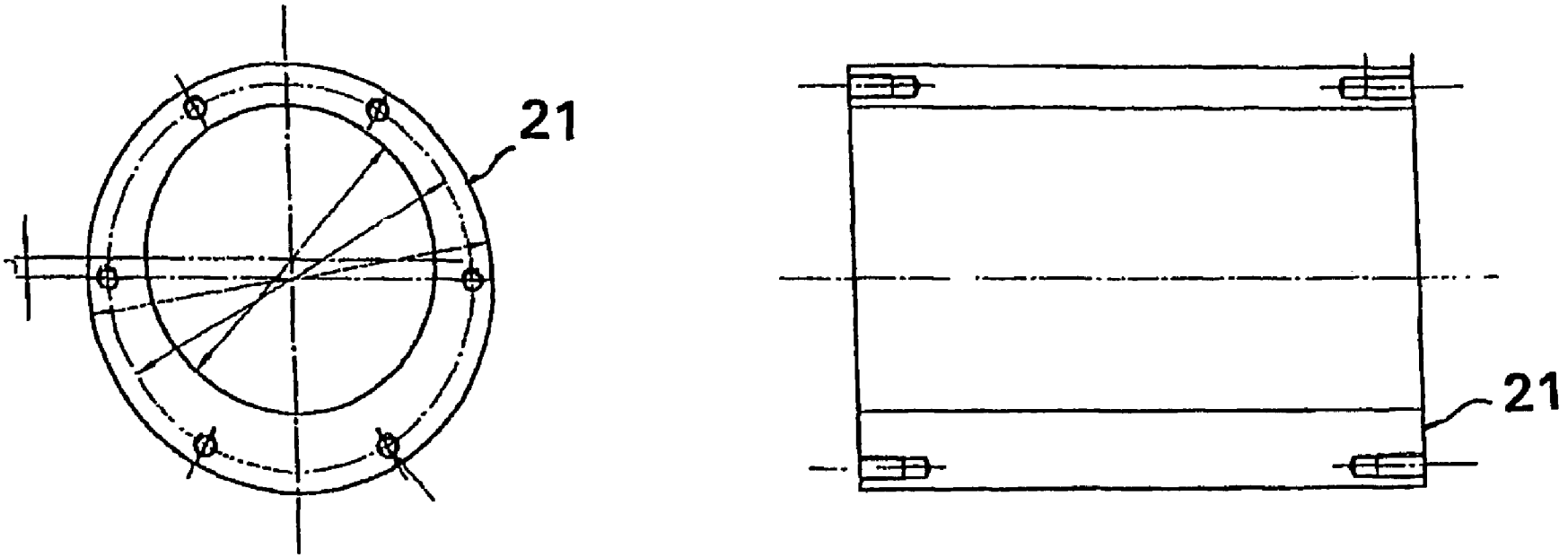
FIG. 5 presents an embodiment of the core sleeve of a device according to the invention.

To assemble the cleaning device illustrated in FIGS. 1*a–b*, 2*a–b* and 3*a–b* so as to make it operative, the cogged belt 17 is first pulled through the barrel and the aperture of the non-rotatable core sleeve 21 from that end of the adapter plate 22 where the aperture is larger, whereupon the ends of the cogged belt 17 are passed over the belt pulleys 5 and 12. After this, the snap-in fasteners 18 and 19 at the ends of the cogged belt 17 are fastened to the corresponding snap-in fasteners 23 and 24 of the core sleeve 21 so that the core sleeve 21 and the brush part 21 can be moved by the cogged belt 17. The eccentric structure consisting of the core sleeve 21 and the adapter plate 22 ensures that the core sleeve 21 remains non-rotatable during the sweeping motion of the brush part 20 in spite of the helical rifles in the barrel. To ensure that the core sleeve 21 will remain non-rotatable, it is also possible to design the core sleeve itself with an eccentricity by making its wall thickness greater on one side, with the result that, due to the larger weight, that side will continuously tend to hang down in the direction of the gravitational force (FIG. 5). The rotating cylindrical brush part 25, which has relatively soft bristles or in some embodiments short and rigid bristles, is replaceable. After the core sleeve 21 and thus also the brush part 20 have been fastened to the cogged belt 17, the end blocks 1 and 8 are tightened in place against the ends of the cannon barrel so as to seal the barrel by turning the hand wheel 14 so that the threaded rod 11 and belt pulley 12 are moved to their outer extreme position, the cogged belt 17 being thus tightened to a sufficient tension. After this, the drive shaft 16 of belt pulley 12 is set in place to lock the belt pulley 12 in an operating position.

The device presented in FIGS. 1*a–b*, 2*a–b* and 3*a–b* additionally comprises valves 9*a* and 9*b* for the supply of cleaning chemicals into the barrel for the cleaning operation and removal of the cleaning residue from the barrel. The valves may be individual valves or valve arrays comprising parallel valves. The gaseous, liquid and/or foaming chemicals needed during the cleaning phase can be supplied into the barrel e.g. from pressurized containers via the valves 9*a* in the end block 8. The residue loosened from the barrel walls can be removed from the barrel via the outlet port 9*b* in the end block 8, e.g. through a closed conduit into a receptacle. The chemical supply valves 9*a* and the cleaning residue removal valves 9*b* are placed either in the end muff 9 or in the operating part 10, e.g. in the midpart of it. In addition, the device may comprise separate rinsing and drying ports for the rinsing and drying of the barrel. The rinsing and drying ports may be disposed in a suitable place in connection with the device of the invention or the barrel. The valves and ports are connected to an automatic control system, which utilizes desired programs to carry out the cleaning process.

Figure 4:
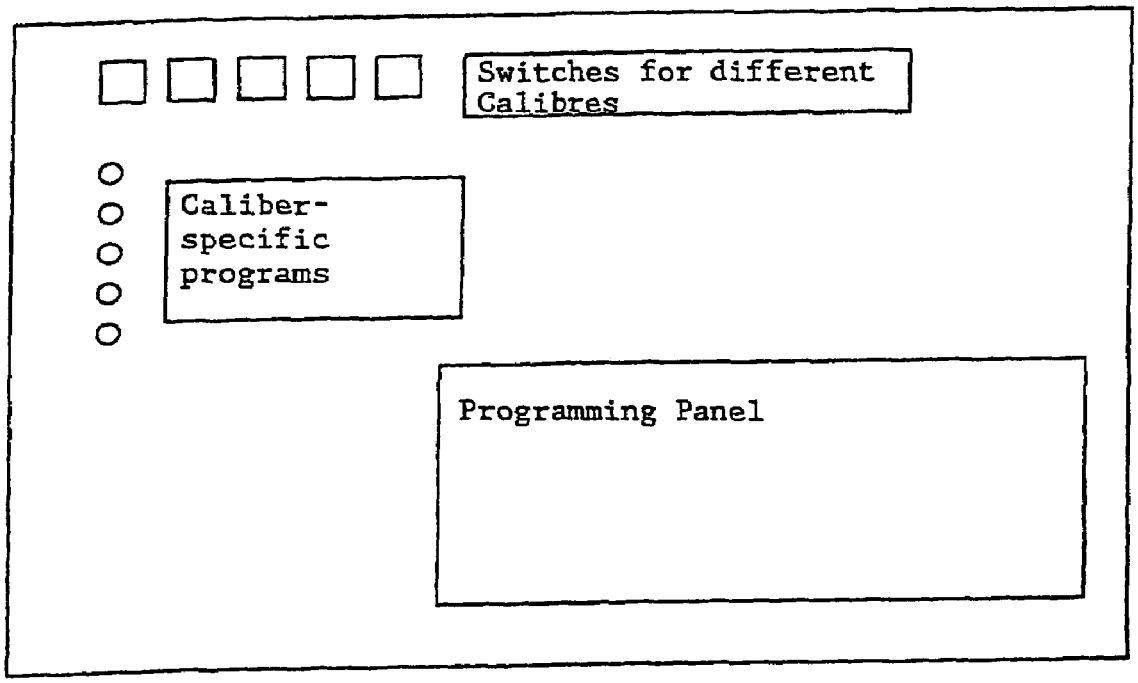
FIG. 4 presents the control unit of a device according to the invention.

The device of the invention additionally comprises a portable control unit (FIG. 4), which is provided with logistics programs for different cleaning operations on barrels of different sizes. From the operating panel of the control unit, it is possible to activate a desired program activated to execute a cleaning process, and to further modify the operating parameters or the program as necessary during the cleaning process or between cleaning processes, or to interrupt the program at any point. Thus, it is possible e.g. to check the barrel by interrupting the program. The control unit enables the device of the invention to execute the cleaning process independently so as to produce the desired final result.

All the various stages of operation comprised in the cleaning process, i.e. the amounts of cleaning chemicals supplied into the barrel, the duration of their retention in the barrel, the reciprocating movements of the brush in the barrel or the extent of the movement in the longitudinal direction of the barrel, its speed and duration, the rinsing of the barrel, the removal of the residue from the barrel, the drying and possible storage greasing of the barrel, can be automatically controlled by means of caliber-specific logistics programs. Moreover, the caliber-specific programs can be adjusted so as to make them concentrate on problematic parts of the barrel type in question. A barrel may e.g. have certain areas subject to more intensive accumulation of copper, in which case the motion of the cleaning brush can be programmed so as to cause it to move several times over such a problematic area where more intensive accumulation of metal residue has occurred.

By means of the control unit, it is possible to activate e.g. a program for cleaning the barrel as follows. First, the cleaning process is started and the cleaning chemicals are introduced into the barrel via valves 9*a*. The electric motor connected via a gear system to the shaft 16 of the belt pulley 12 is started and causes the brush 20 to move back and forth in the barrel in accordance with the instructions given by the control unit. The speed of motion of the brush 20 in the barrel can be varied by altering the transmission ratio of the gear system. According to the cleaning procedure programmed in the control unit, the direction of motion of the brush 20 is changed each time when the brush at one end reaches end block 1 at the breech end of the barrel and at the other end the end muff 9 of end block 8. In accordance with the program, the brush is also caused to move several times back and forth over one or more problematic areas in the type of barrel to be cleaned where larger amounts of metal and other residue have accumulated, observing the cycles and time attributes defined by the program. After the cleaning/brushing stage, the waste scoured off the barrel walls is removed from the barrel via the outlet port 9*b*, whereupon, if desired, the barrel is rinsed and dried. For rinsing, a rinsing agent is introduced into the barrel, e.g. via the chemical supply port 9*a* or via a separate rinsing port. The residue produced during the rinsing can be removed. e.g. via the outlet port 9*b*. The drying can be performed using e.g. compressed air or a desiccating liquid or equivalent, which is passed into the barrel e.g. via a valve mounted at the breech end of the barrel or directly through the end of the breech. Before the end blocks 1 and 8 are removed, the barrel can be additionally inspected, e.g. by means of an endoscope, whereupon the cleaning program may execute a storage greasing operation if the barrel in question is not to be taken into use immediately after the cleaning. The storage greasing can be performed automatically by the program e.g. via the chemical supply port 9*a*.

In the device presented in FIGS. 1*a–b*, 2*a–b* and 3*a–b*, to control the motion of the brush 20 in the barrel, it is possible to provide the drive shaft 16 of the belt pulley 12 with a pulse transducer 16*a* that produces e.g. 100 impulses per revolution. This pulse transducer 16*a* is in coaction with an inductive sensor 9*c* mounted on the end muff 9, said sensor being arranged to output a command to the control unit when a metal nib 20*a* mounted on the brush 20 comes into contact with it. This results in starting a predetermined program, which can adjust the direction of the brush 20, or its stroke length at any point along the barrel, observing the cycles and timed programs.

The motion of the freely rotatable brush in the barrel may alternatively be implemented using e.g. the vibrating technique, screw drive technique, ball screw technique, a wire cable or a corresponding technique.

The device is designed to be operated by e.g. 230 V, 110V electric power or by a 12–14 V current obtained from a vehicle, which means that power is available in any conditions, or alternatively by purely manual power. The device has a size and weight allowing easy transportation. The device can be packed in two suitcases, which can be carried by one man. The control unit is placed in a small briefcase, and it has various switches or control panels that can be used to activate programs in the control unit regarding different calibers and barrel lengths. Housing the control unit in a separate portable briefcase, which can be removed from the device after the cleaning functions, is a kind of security factor especially in crisis situations.

The valves of the cleaning device may be electrically controlled, laser or radio controlled, in which case no conductors are needed between the control unit and the valves.

In the cleaning method of the invention, the cleaning chemicals used may consist of only gaseous cleaning chemicals, such as compressed air, oxygen or nitrogen. In an alternative embodiment of the method, a gaseous and a liquid cleaning chemical are used simultaneously. In this case, the gaseous cleaning chemical is often used as a foaming agent for foaming the liquid cleaning chemical. In another alternative embodiment of the method, a gaseous cleaning chemical is used e.g. at a different phase with a liquid cleaning chemical.

In the method of the invention, the barrel is only partially filled with a cleaning agent, which preferably is a foaming/foamed cleaning agent. The application of the cleaning agent on the barrel wall is implemented by moving the brush of the device a few times forwards and backwards in the barrel, thereby also increasing the foaming. This promotes the adhesion of the cleaning chemicals on the barrel walls. Due to the efficiency of the cleaning agent, the barrel can be brushed using a relatively soft brush, which contributes to protecting the barrel from damage.

By adding a small amount of ammonia into the chemical mixture, a reaction mixture is obtained that dissolves copper, bronze and brass compounds in a few seconds. According to another embodiment of the invention, a small amount of gasifiable strong ammonia is fed into the barrel, with the effect that the copper accumulated in the barrel is dissolved in a few seconds. The quantity of ammonia required varies from a few grams to a few hundred grams, depending on the size of the barrel. The residue is removed by brushing. In the method of the invention, as the entire cleaning activity takes place in a fully closed space, ammonia can be safely used without hazard to personnel and the environment.

According to another embodiment of the method, a negative pressure is generated in the closed barrel, whereupon a prescribed amount of cleaning chemicals is allowed to be drawn into the barrel by the action of the negative pressure prevailing in it. When e.g. ammonia or some other gasifiable chemical is used, the amount of chemicals needed in connection with this embodiment is significantly reduced. To remove the residue from the barrel, it is also possible to utilize a negative pressure generated in the receptacle.

If a negative pressure is to be generated in the barrel, the device may also comprise a vacuum pump connectable to the barrel. For removal of residue, this pump can be connected to the receptacle.

If the barrel is cleaned using gas only, the residue loosened from the barrel surface can be easily recovered. Most of the gas fed into the barrel can be returned by pumping into a pressurized storage container after the chemical cleaning phase, which means that the consumption of effective agents remains very low.

In the method of the invention, it is possible to make advantageous use of existing 26-kg pressure vessels, which have been developed for use in a foam technique as disclosed in FI patent 97727. When gas alone is used, a very small amount of it is needed, i.e. a few grams to a few hundred grams, depending on the size of barrel. The gas is stored in a safe pressure vessel as mentioned above, which has an automatic closing mechanism in case the pressure in the device should suddenly fall for any reason. The cleaning efficiency can be readily controlled by means of the gases used in the invention.

In the method of the invention, copper and incrustation residue can be neutralized or recovered.

In the method and device of the invention, the ends of the barrel are closed with end blocks designed according to its caliber, and the end blocks can be fitted to close and seal off both end apertures of the barrel. The holes of the flash hider may be closed with a separate collar. To keep the end blocks firmly and securely in place, especially in the case of cannons and larger shell throwers, the end blocks can be connected together by means of the cleaning element drawn through the barrel or by using a separate means. In a device designed for the barrels of small-caliber firearms, the end blocks are tightened around the two ends of the barrel and the cleaning brush may be a manually operated brush with a handle passed through a sealing sleeve in the end block closing the barrel mouth, said end block being also provided with chemical supply ports and an outlet port for the removal of the residue detached from the barrel wall.

The cleaning method and device of the invention are applicable as different embodiments for cleaning guns of different types and sizes efficiently and at a lower cost than before. In principle, one method and one device can be applied to clean all guns of the same type, e.g. cannons, by only adding appropriate fittings depending on the caliber.

The embodiments of the invention are not limited to the examples presented above but may instead be varied in the scope of the following claims.

The invention claimed is:

1. Device for cleaning the barrel of a gun, comprising end blocks sealably fittable to each end of the barrel and a reciprocable mechanical cleaning element to be placed in the barrel, characterized in that the cleaning element comprises a core sleeve of a size smaller than a barrel caliber and a brush part of a size adapted to the barrel caliber and freely rotatably mounted around the core sleeve, and a reciprocatingly-moved drive means passed through an aperture of the core sleeve and designed to fit the length of the barrel, the core sleeve and/or brush part being attached to said drive means characterized in that the drive means is a cogged belt arranged to run round belt pulleys mounted on the two end blocks.

2. Device as defined in claim 1, characterized in that a shaft of one of the belt pulleys is a drive shaft connected via a gear system to an electric motor rotatable in both directions.

3. Device as defined in claim 1, characterized in that at least one of the end blocks is provided with a control mechanism to allow the position of the belt pulley mounted on it to be adjusted in the direction of the barrel.

4. Device as defined in claim 1, characterized in that the core sleeve and/or the brush part are/is attached to a track of the drive means.

5. Device as defined in claim 1, characterized in that each end of the core sleeve is provided with a snap-in fastener, by means of which it can be fastened to a corresponding snap-in fastener of the drive means.

6. Device as defined in claim 1, characterized in that the each end of the cogged belt is provided with a snap-in fastener to which a core sleeve snap-in fastener of the core sleeve can be fastened.

7. Device as defined in claim 1, characterized in that the brush part is replaceable.

8. Device as defined in claim 1, characterized in that the core sleeve is provided with an adapter plate extending eccentrically, these two parts together forming an eccentric structure.

9. Device as defined in claim 1, characterized in that the core sleeve is of an eccentric construction so that its wall thickness is larger on one side.

10. Device as defined in claim 1, characterized in that at least one of the end blocks comprises at least one port for the introduction of cleaning chemicals into the barrel, removal of cleaning residue from the barrel and rinsing and/or drying of the barrel.

11. Device as defined in claim 1, characterized in that the device comprises a portable control unit provided with logistics programs for different cleaning phases in the cleaning of barrels of different sizes.

12. Device as defined in claim 1, characterized in that at least one of the end blocks is provided with a control mechanism to allow the position of the belt pulley mounted on it to be adjusted in the direction of the barrel.

13. Device as defined in claim 7, characterized in that each end of a cogged belt is provided with a snap-in fastener to which a core sleeve snap-in fastener of the core sleeve can be fastened.

* * * * *